US005301661A

United States Patent [19]

Lloyd

[11] Patent Number: 5,301,661

[45] Date of Patent: Apr. 12, 1994

[54] ROTARY MOTION BED APPARATUS

[76] Inventor: Bruce C. Lloyd, R.R. 2, Box 637, Orillia, Ontario, Canada, L3V 6K5

[21] Appl. No.: 727,083

[22] Filed: Jul. 9, 1991

[51] Int. Cl.[5] ..... A61H 7/00

[52] U.S. Cl. ..... 601/84; 601/87; 601/88; 601/100; 601/101

[58] Field of Search ..... 5/108-110; 128/33, 44, 48-53, 56

[56] References Cited

U.S. PATENT DOCUMENTS

| | | | |
|---|---|---|---|
| 2,243,013 | 5/1941 | Morey et al. | 128/52 |
| 4,256,095 | 3/1981 | Graham | 5/109 X |
| 4,277,857 | 7/1981 | Svehaug | 128/33 X |
| 4,483,327 | 11/1984 | Graham et al. | 5/109 X |
| 4,586,492 | 5/1986 | Manahan | 128/49 X |
| 4,858,598 | 8/1989 | Halpern | 128/33 |
| 4,858,599 | 8/1989 | Halpern | 128/33 |
| 5,042,097 | 8/1991 | Fuchs | 5/109 X |

*Primary Examiner*—Robert A. Hafer
*Assistant Examiner*—Brian E. Hanlon
*Attorney, Agent, or Firm*—Fitch, Even, Tabin & Flannery

[57] ABSTRACT

An improved rotary bed apparatus with a supplemental pneumatic support is provided for imparting rotary motion to a bed supporting a subject thereon. Switches associated with the apparatus are provided to cut off rotary power and move the bed to a safe dismount position when the power is cut off by the subject or attendant or in the event a subject accidentally falls or moves from the bed surface.

9 Claims, 3 Drawing Sheets

ROTARY MOTION BED APPARATUS

BACKGROUND OF THE INVENTION

1. Field of the Invention

This invention relates to an improved apparatus for providing a rotary movement of a bed for carrying a person or subject thereon through a rotary path movement. The apparatus is useful in providing for relaxation of a person carried thereon and particularly is useful in relieving stress in a human subject by the relaxing effect of the rotary movement of the subject provided by the said apparatus.

2. Description of Related Art

U.S. Pat. No. 1,791,777 to Webb is directed to a device which produces an irregular raising and lowering of its extremities in an attempt to simulate the gait of a horse. This apparatus does have eccentric throw wheels to produce an up and down motion independently at each end. As stated in the opening paragraph on Page 1, "a device which is so designed to simulate the motions of a horse, etc."

U.S. Pat. No. 2 - 4,175,550 to Leninger is directed to a bed device which provides a pendulum-like motion.

U.S. Pat. No. 3 - 4,194,499 to Donnelly describes a device which raises and lowers the "foot end" of the bed by means of an adjustable throw-arm. The "head end" pivots around a stationary point. This produces a rocking motion somewhat similar to Leninger, but the motion is pivotal and end to end, instead of side to side. Only the foot end of the bed moves.

U.S. Pat. No. 4,256,095 describes an apparatus for treating a person or subject in controllable and electric fields. That patent generally describes an apparatus having a supporting surface such as a bed to carry a person through a rotational path and in addition includes a generator means for producing a low frequency signal to electrodes disposed at opposite ends of the transport means or bed to produce an electric field between the ends of the electrodes and through the person or subject resting thereon.

U.S. Pat. No. 4,194,499 patented Mar. 25, 1980 relates a bed for stimulating circulation comprising a pivotally mounted bed frame wherein the bed surface is pivotally moved about a horizontal axis to elevate through various upper and lower inclined and dwell positions about a horizontal axis.

My U.S. Pat. No. 4,483,327 patented Nov. 20, 1984 describes a machine for relieving stress and anxiety in the absence of any electric field. This machine includes a transporting device with a supporting surface adapted to carry a person through a circular or rotary path or movement. The present invention involves improvements to apparatus as generally described in my above noted patent.

SUMMARY OF THE INVENTION

Present invention relates broadly to a rotary movement bed apparatus which includes a bed platform means suitable for carrying and supporting a subject on the surface thereof through a circular or rotary path of movement, a supporting frame member means, a rotary drive means mounted in said frame means to said platform, a driven mechanical linkage means operatively connected and between said platform and drive means to support the platform and impact rotary circular path motion to be responsive to the rotary drive means, and pneumatic means operatively connected to and between said frame and platform means to provide supplemental support to the bed platform.

More particularly, the present invention relates to a rotary or circular motion bed apparatus comprising:

(a) a bed platform means having a length and width sufficient to carry on the surface thereof a horizontally reclining subject through a circular movement in a vertical path perpendicular to the longitudinal plane and axis of said platform;

(b) a supporting frame member;

(c) rotary drive means mounted on said frame member adapted to support and move said platform in a circular path;

(d) a mechanical linkage means operatively connected to and between the rotary drive means and said bed platform means and adapted to hold said platform so that its directional orientation stays the same as said platform moves along said circular path responsive to said drive means, said mechanical linkage means including four parallel elongate members of equal length connecting said rotary drive means to said platform, said elongate members being each pivotally connected at one end thereof to said platform at spaced apart locations, and pivotally connected to said rotary drive means; and (e) pneumatic means operatively connected to and between said frame and platform means to provide support to said bed platform means during operation of said apparatus.

According to the present invention, an apparatus is provided for relieving stress in a human subject which comprises an elongated horizontal platform having a length and width sufficient to carry a horizontally reclining subject's body through a circular movement. The movement provided by the apparatus of the present invention is circular or rotary in a vertical plane which is perpendicular to the longitudinal axis of the platform or bed and more particularly, perpendicular to the plane described by the surface of the bed or subject support. The rotary drive means provides the power to move the platform and associated bed means along a circular path. In the apparatus of the present invention a mechanical linkage is connected to the platform to hold the platform in a position so that its directional horizontal orientation remains the same as it moves along the circular path. A further and principal load bearing support means is provided by a pneumatic means connected between the frame and the platform providing both support to the platform means and also a pneumatic support effect to the rotary motion provided by the rotary drive means and associated mechanical linkage connected to the platform.

Certain safety features are incorporated into the apparatus of the present invention in the form of a single electric switch whereby the rotary motion can be stopped, the pneumatic support pressure removed, and the bed surface returns to a fixed and stable at-rest position thereby permitting the subject to dismount or mount the bed surface with relative safety. The rotary motion provided to the bed platform is such that a subject resting on that platform is carried through a circular or rotating path. It is known in the medical arts that such rotational movement of a subject's body is useful to provide beneficial relaxation, stimulus of involuntary muscular reaction in response to the mechanical motion of the platform which in turn improves muscle tone and circulation of the subject. Unlike many other prior art devices the use of the apparatus of the present invention for relaxation can be carried out in the absence of an electrical field and is mechanical in its rotary motion effect on the subject's body.

BRIEF DESCRIPTION OF THE DRAWINGS

Other features and advantages will be apparent from the following description of the preferred embodiments in conjunction with the accompanying drawings, wherein.

DETAILED DESCRIPTION OF THE PREFERRED EMBODIMENT

Figure 1:
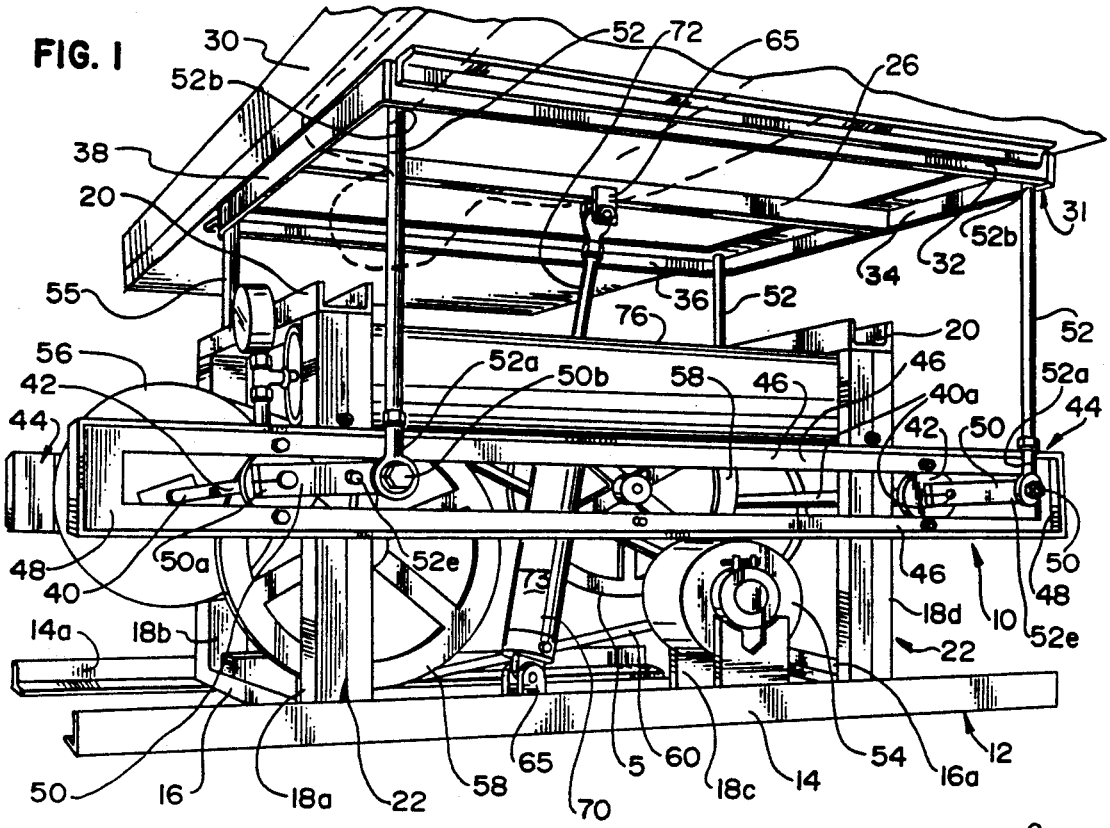
FIG. 1 is a perspective view of the apparatus of the present invention.
Figure 2:
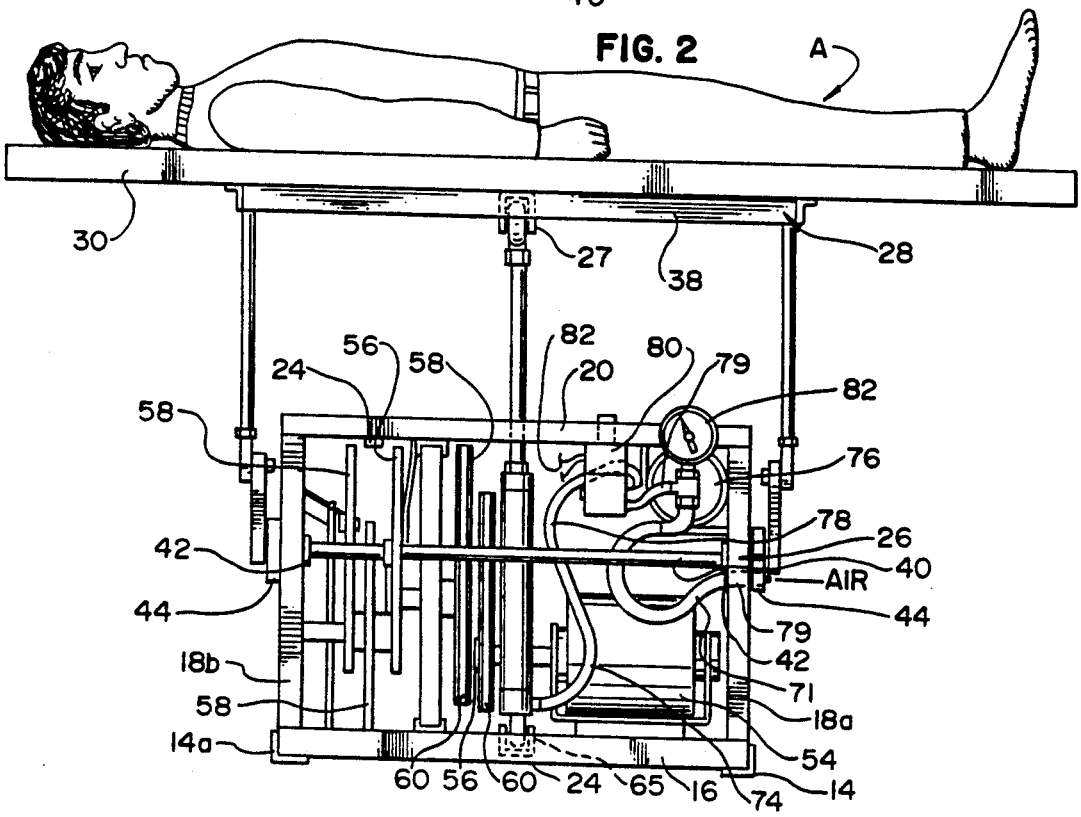
FIG. 2 is an end elevation of the apparatus of FIG. 1 showing a subject reposing on the support surface or bed of the apparatus.
Figure 3:
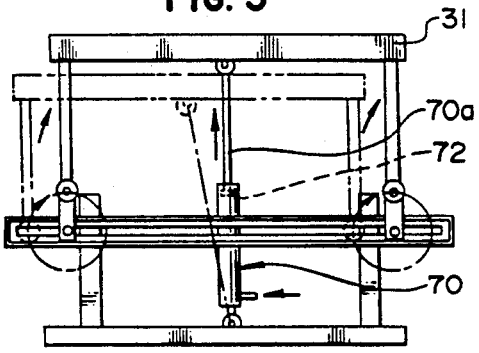
FIG. 3 is a side elevation in schematic form of the apparatus of FIGS. 1 and 2 showing the cooperative relation between the rotary drive means, associated linking means and the bed platform and the supplemental pneumatic support means provided by a pneumatic means, said platform being positioned at its highest or most extended top-dead-center position.
Figure 4:
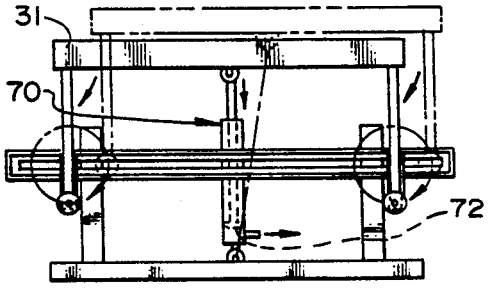
FIG. 4 is another side elevational schematic drawing similar to that of FIG. 3 showing the relationship of the rotary drive means and pneumatic means when the bed is at its lowest bottom-dead-center position for safe mount and dismount of a patient.

Referring to the drawings, particularly FIGS. 1 and 2 thereof, there is illustrated one preferred embodiment of a rotary bed apparatus embodiment 10 of the present invention which can provide oscillatory rotary motion to a subject, i.e., a person, resting on a bed surface disposed thereon to relieve stress of the subject while the apparatus is in operation.

The apparatus 10 illustrated includes a support frame means 12, including a pair of spaced apart horizontal base members or rails 14 and 14*a* of L-shape (angle iron) which are designed to rest on floor surface, a pair of spaced apart U-shaped or channel-shaped cross members 16 and 16*a* are attached at the respective ends thereof, at right angles to the base members 14 and 14*a* to extend horizontally between said members 14 and 14*a*. The method of attachment may be by welding, bolt or rivets. Four U-shaped or channel form support posts 18*a*, 18*b*, 18*c* and 18*d* are affixed at their respective lower one ends to the cross members 16 and 16*a* and extend upwardly or vertically therefrom. A pair of upper cross members 20 are affixed to the upper other upper ends of the upright supports 18(*a–d*) to form a pair of spaced apart box-like frames 22 of the elements 16, 18 and 20 which rest on the base members or rails 14 and 14*a*. These frame elements of frames 22 are preferably welded together but may be bolted for ease of assembly or disassembly. The spaced apart frames 22 are disposed between and are permanently affixed to the horizontal base supports 14 and 14*a* by welding or bolts. The two box-like frames 22 are connected at their upper ends, that is member 20, by further cross members 24 parallel to rails 14 and 14*a* to further rigidify the structure.

The apparatus 10 includes a movable, driven transport or bed support means 28 adapted to support a horizontal bed or bed-like surface 30 on which a subject indicated as "A" in FIG. 2 may be disposed in a reclining or resting horizontal position. The supporting and transport means 28 comprises a plurality of transport frame members 32, 34, 36 and 38 which are interconnected at their ends to form a generally rectangular structure defining a plane at the top thereof, on which the bed or bed-like unit 30 may be affixed or disposed. The bed 30 may be secured to the frame comprising elements 32–38 by means of conventional bolts, brackets and screws, not shown.

A rotary drive mechanism is affixed to the frame 12 provided to move or drive the bed transport means 28 comprising the rectangular frame formed of elements 32, 34, 36 and 38, along a circular or rotary path. In this illustrated embodiment, the rotary drive means includes two rotatable horizontal shafts 40 which extend transversely between the space defined by the two frames 22, as shown in FIG. 1. The respective ends 40*a* of each of the shafts 40 rotate in a pair of bearings 42 which are mounted in and on a pair of outer rectangular shaft support frames 44 affixed to upright posts 18 *a, b, c,* and *d* of frames 22. The outer shaft support frames 44 each comprise a pair of spaced apart parallel longitudinal members 46 and connecting parallel side members 48 to form a box-like frame illustrated as 44, whose elements are connected together by welding or other suitable means. The bearing carrying frame 44 is connected to the top of uprights 18 of the two rectangular frames 22 at their outer sides 18 (*a*) and (*d*) and (*b*) and (*c*). The ends 40*a* of the shafts 40 extend beyond the bearings 42 and are connected to a rigid offset or throw arm 50 at one end 50*a* thereof. The other end 50*b* of the offset arm 50 is pivotally connected by pivots to the respective ends of four upright bed support rod-like linkages 52 at 52*a*. The other upper end 50*b* of the upright support linkages 52 is rigidly connected to the frame member 31 comprised of rectangular elements 32–38. The rigid offset arm 50, which is connected to the shaft 48, rotates with the shaft and being offset, eccentrically drives the upright bed support elements 52 in turn attached to the frame 31 in a rotary fashion which follows the motion of the rotation of the arm 50. Thus, the degree of rotary motion or eccentric transmitted to the bed supporting frame through the shaft, offset arm and supporting elements can be adjusted by adjusting the pivot point or effective length of the offset arm at 50(*b*). If desired the offset arm has a plurality of pivot attachment holes or points such as 52*e* formed therein at the end 50(*b*) opposite the connection to the shaft to adjust the degree of eccentricity or rotary motion transmitted to the bed supporting frame 31. Of course, all of the offset arms are positioned so as to maintain positional uniformity of angle of the offset from the center of shaft rotation so that the bed support frame 31 will be evenly moved in a rotary path when the rotary shafts are driven by a rotary drive means and maintained in a horizontal position.

The rotary drive means includes an electric motor means 54 which is connected through a suitable series of speed reduction means to a series of sprockets 56*a* or pulley wheels 56 which are respectively attached to the two drive shafts 40. The sprockets or pulleys 56 on shafts 40 are driven through a series of pulleys and connecting belts 60 or sprockets and connecting chains 60*a* which comprise means to reduce the speed of the motor with a rotary output of commonly about 1725 r.p.m. to a rotational speed that is suitable for a rotation of the transport means and the subject thereon of 3 to 15 cycles per minute. These interconnecting pulley or sprocket means are generally indicated in the drawings as elements 56 and the belt or chains as elements 60 which run on shafts 62 and 63 which are pivotally mounted in the frame.

Figure 5:
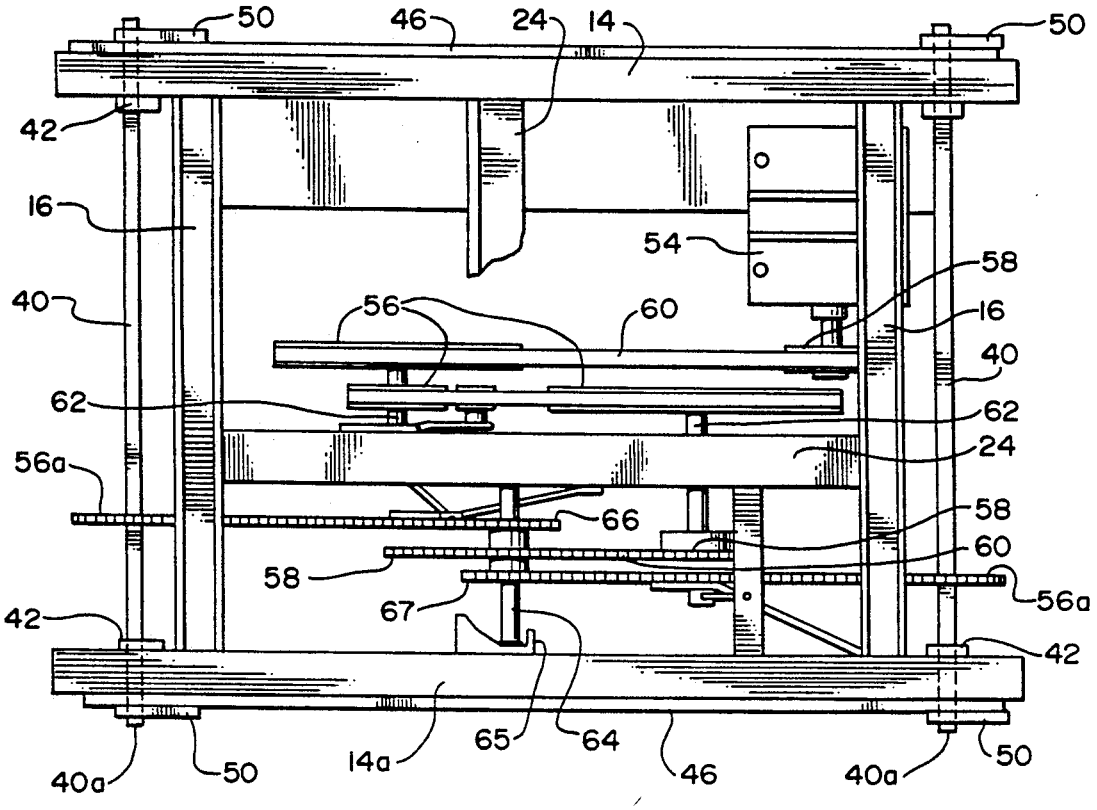
FIG. 5 is a partial bottom view of the apparatus of FIG. 1 showing the speed reduction system of the rotary drive means.

As best shown in FIG. 5, the motor drive rotational speed is reduced by a series of these belt and pulley systems and the motor power transmitted to a main drive shaft 64 means pivotally mounted on a bracket 65 affixed to the frame where the rotational power is divided and by sprockets or pulleys 56*a* of equal size transmitted to pulley or sprockets 56 mounted the respective shafts 40 by belts or chains 60.

A pneumatic means 70 is positioned to provide pneumatic support to the transport frame 31 and the bed and patient resting therein. The pneumatic means 70 is a conventional piston 72 and cylinder 74 device operated by air pressure. Means 70 particularly piston rod 72 is affixed at one end to cross member 26 by frame 31 by a trunion 65 and at the cylinder end 74 to another cross member 24 between face frame members at trunion 65.

Figure 8:
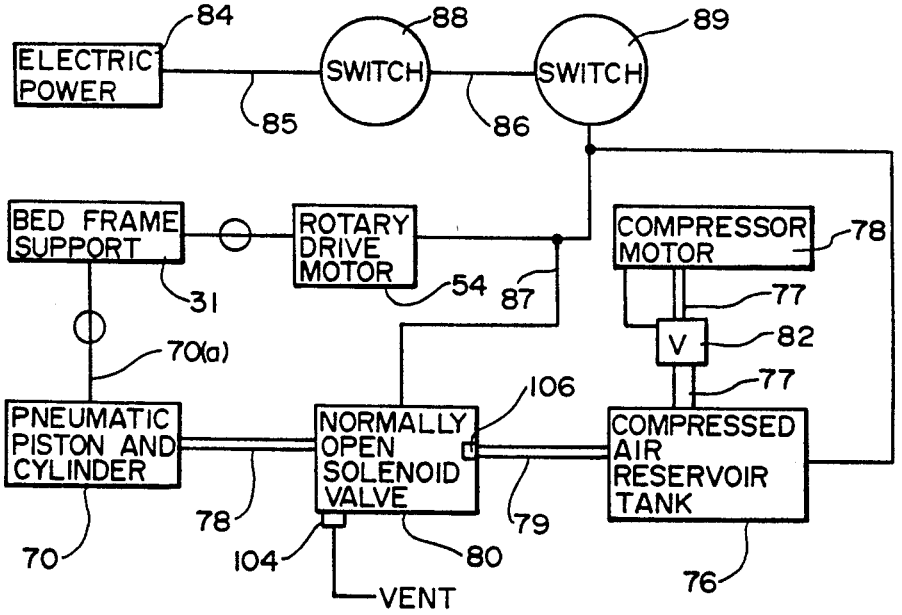
FIG. 8 is a schematic diagrammatic drawing of the control and operation system of the apparatus of the present invention.

As also illustrated schematically in FIG. 8, pressurized air is supplied to the pneumatic piston and cylinder means 70 from compressed air reservoir tank 76 via on line 74. Tank 76 is supplied with compressed air from motorized air compressor 78 via air lines 77 to the pneumatic piston and cylinder means 70 and lines 78 and 79 though an intermediate solenoid valve 80. Solenoid valve 80 is normally open when not energized and when open acts by spring pressure to vent compressed air from the piston and cylinder means 70 (via port 105) via port 104 when electric current to the solenoid from source 84 is cut off by opening of switches 88 or 89. The air pressure in pneumatic means 70 and associated air lines and air reservoir tank 76 is regulated by control valve 82 including an electric switch which responds to a pre-set, predetermined tank air pressure set to accommodate the total load on bed 30 on bed support frame 31 and subject A. The pressure setting of 82 should be first sufficient to accommodate that weight load but not so high as to hinder rotation and piston back pressure on mechanical cycling of the associated load on 30 by the rotation of the bed support 31.

Figure 7:
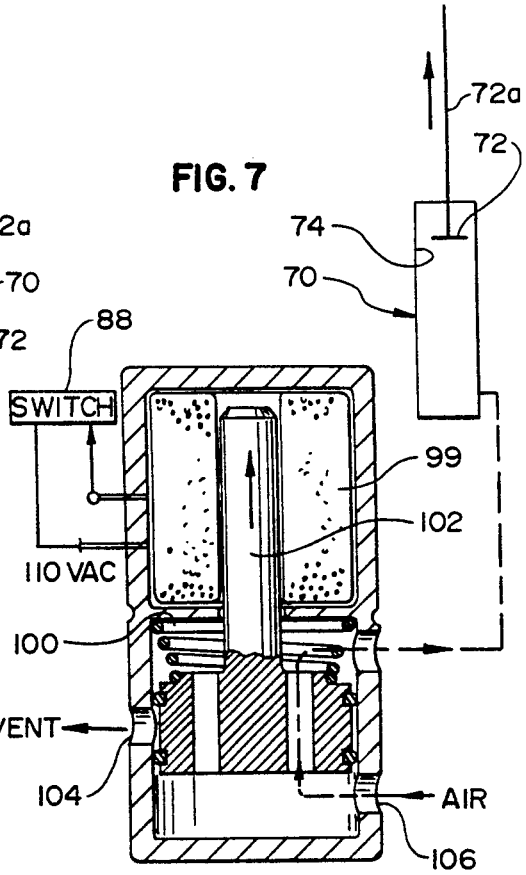

As shown in the schematic drawing FIG. 8, the system has a source of electric power or current 84 which is sent via wires 85, 86 and 87 through main switches 88 and 89 to pressure operated control valve switch 82 and from valve switch 82 to operate compressor motor 78 and to solenoid valve 80. With main switches 88 and 89 closed, the motor compressor is energized by pressure sensing switch 82 to energize motor compression or other source of compressed air to deliver compressed air to air reservoir tank 76 at predetermined load level set by electrical pressure sensing control valve 82. Compressed air from reservoir tank 76 is fed via air lines 79 and 78 to the cylinder 74 of pneumatic means 70 which drives the piston 72 upward to lift the load on frame 31 and provide a air cushioned support during rotation of the bed frame 31 and associated load. As shown in FIG. 7 the pneumatic means 70 drives the piston rod 72(*a*) upwards against frame 31 lifting the load which is rotated by linkage means driven by rotary motor drive means 54. In FIG. 8 the downward rotation is shown where support 31 presses down on the piston rod 70(*a*) by rotation of the drive means 54, pneumatic means 70 providing an air cushioned buffer and supportive effect to the load on frame 31 and bed 30.

When a subject desires to dismount or mount the rotating bed apparatus, it is desirable that the bed be in a stable position, desirably at its lowest rotational level. In such case opening manually operated switch 88, cuts the power to the motor 54, ceasing all rotary motion of the bed 30, cuts off power to the motor compressor 78 and opens the normally open solenoid valve 80 when the solenoid is de-energized and the compressed air is vented. The bed frame 31 and bed 30 then drops to and remains at bottom-dead-center for safe dismount. A second normally open safety switch 89 in series switch 88 is operated and maintained in the closed position by reason of the pressure of a subject on the bed 30. In the absence of subject pressure, switch 89 opens to cut off all power and by reason of cutting power to solenoid valve 80, the valve 80 vents compressed air from the piston cylinder means 70 as described below, and permits the bed to fall by gravity to its bottom-dead-center or dismount position.

Figure 6:
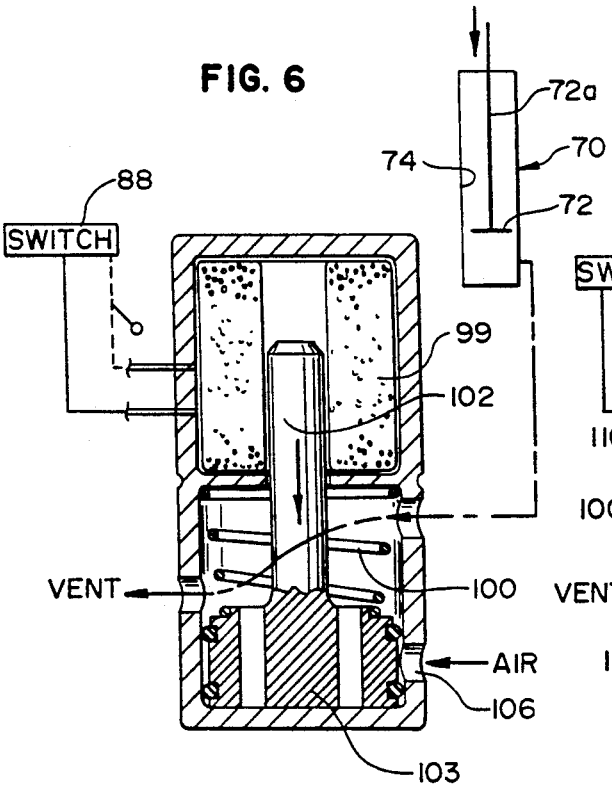
FIGS. 6 and 7 are schematic views of an electric solenoid valve in partial section connected to the schematically shown pneumatic means.

The solenoid operated switch 80 is shown in FIGS. 6 and 7. In FIG. 6, the main switch 88 and safety switch 89 are open, current to the solenoid coil 99 is off and the spring 100 drives the solenoid 102 and valve port closure member 103 down in the direction of the arrow, opening the vent 104 and closes valve port 106 and pressurized air in piston and cylinder means 70 is vented via 104 to the atmosphere and its piston 72 drops together with bed and bed support to the bottom dead center position. By closure of valve port 106, compressed air in the system together with the pressurized air in the air reservoir 76 and associated air lines to the motor compressor 78 remains under pressure for later start up of the apparatus without repressurization of the entire system.

As shown in FIG. 7, with electric power on by reason of closure of switches 88 and 89 , the solenoid coil 99 is energized and the solenoid 102 is pulled up in the direction of the arrow against the pressure of spring 100 into the coil 99 with member 103 to close the vent port 104, open valve port 106, and send compressed air from tank 76 to pneumatic means 70 to drive the piston 72 to its operational air cushioned support position.

Moreover, in the event that a subject decides to leave the bed of the apparatus during operation without cutting the main power switch 88 or accidentally rolls to a position at the edge of the bed when he or she could roll off the bed and risk injury, the pressure operated safety switch 89, in the absence of subject body weight pressure, opens, and cutting all electric power to the rotary power motor, air compressor and opens the solenoid valve and vents the pressurized air in the piston and cylinder means 70 returning the bed to a safe dismount, low accident risk bottom-dead-center position.

While other variations and modifications of the apparatus are possible, the disclosed embodiment describes an apparatus which provides a rotary notion to a bed and in turn a relaxing motion to a subject using the same, with both safety and ease of movement and dismount for the said subject.

What is claimed is:

1. A rotary motion bed apparatus comprising:

a. a bed platform means having a length and width sufficient to carry on the surface thereof a horizontally reclining human subject through a circular movement in a vertical circular path perpendicular to the longitudinal axis of said platform;

b. a supporting and mounting frame member;

c. a rotary drive means mounted on said frame member adapted to support and move said platform in a circular path;

d. a mechanical linkage means connected to said platform and adapted to hold said platform so that its directional orientation stays the same as said platform moves along said circular path responsive to said drive means, said mechanical linkage means including four parallel elongate members of equal length connecting said rotary drive means to said platform, said elongate members being each pivotally connected at one end thereof to said platform at spaced apart locations, and pivotally connected to said rotary drive means;

e. pneumatic means comprising a pneumatically driven piston and cylinder combination means operatively connected to and between said frame and bed platform means to provide supplemental pneumatic compressed air support to said platform means;

f. a source of compressed air operatively connected to said pneumatic piston and cylinder means to provide pressurized air to said piston wherein said source of compressed air includes a compressed air reservoir, an electrically driven air compressor connected to said air reservoir and regulator control means associated with said air compressor and reservoir adapted to maintain sufficient pressure in said reservoir and associated pneumatically driven piston and cylinder means so as to provide an air cushioned buffer supportive effect for a predetermined load on said bed platform; and g. an electrically operated solenoid valve means connected to the compressor and compressed air reservoir, positionable between an activated closed position to thereby maintain pneumatic pressure therein and an open inactivated position adapted to exhaust pressurized air from the pneumatic piston and cylinder means, and permit the bed platform to drop to a bottom dead center dismount position, said apparatus further including a series connected manually operated switch and a patient load responsive electric switch means to simultaneously cut electric power to said rotary drive means, air compressor, and electrically operated solenoid valve means when said switch and said switch means are opened.

2. Apparatus according to claim 1, wherein said solenoid valve means is positioned to maintain a predetermined air pressure between said reservoir and associated pneumatically driven piston and cylinder means sufficient for said pneumatic piston and cylinder means to provide substantial pneumatic support of a load on said upper frame.

3. Apparatus according to claim 1, wherein air pressure in said pneumatic piston and cylinder means and said compressed air reservoir is maintained at a predetermined load supporting level responsive to said regulator control means.

4. Apparatus according to claim 3, wherein said regulator control means has a switch means connected with said compressed air reservoir and electrically driven compressor to sense and maintain pneumatic pressure in said reservoir at predetermined levels, said regulator control switch means actuating said motor driven compressor means in response to changes in pressures sensed by the regulator control means within predetermined limits.

5. Apparatus according to claim 1 wherein said patient load responsive switch means includes a normally open pressure actuated switch means between a closed power transmitting position by load pressure of a patient on said bed and an open, non-power transmitting position when said patient load pressure is absent.

6. Apparatus according to claim 5 wherein said patient load responsive switch means is positioned to transmit electric power when closed to said rotary drive means and said solenoid valve means and disconnect power to said rotary drive means, solenoid valve means and air compressor when open.

7. Apparatus according to claim 1 wherein said manually operated switch provides power to said rotary drive means and air compressor and solenoid valve means when closed.

8. Apparatus according to claim 1 wherein said patient load responsive switch means is activated and closed by the pressure of the weight of a subject on the bed to transmit electric current to said rotary drive means, air compressor and solenoid valve means.

9. Apparatus according to claim 1 wherein said electric solenoid valve means for venting air when open is powered by said series connected manually operated switch and patient load responsive switch means when said switch and said switch means are closed.

* * * * *

UNITED STATES PATENT AND TRADEMARK OFFICE

CERTIFICATE OF CORRECTION

PATENT NO. : 5,301,661
DATED : April 12, 1994
INVENTOR(S) : Lloyd

It is certified that error appears in the above-indentified patent and that said Letters Patent is hereby corrected as shown below:

TITLE PAGE:

[52] U.S. Cl., change "601/84" to --128/44--.

Claim 5, Column 8, line 26, change "actuated switch means" to --actuated switch actuated--.

Signed and Sealed this

Twenty-third Day of May, 1995

*Attest:*

BRUCE LEHMAN

*Attesting Officer*

*Commissioner of Patents and Trademarks*